US005695275A

United States Patent [19]

Markiewicz et al.

[11] Patent Number: 5,695,275

[45] Date of Patent: Dec. 9, 1997

[54] LIGHTING FIXTURE

[75] Inventors: John Markiewicz, Mentor; Doug Lostoski, Richfield; Chuck Riedy, Lakewood, all of Ohio

[73] Assignee: The Lamson & Sessions Co., Cleveland, Ohio

[21] Appl. No.: 715,835

[22] Filed: Sep. 19, 1996

[51] Int. Cl.[6] ..... F21V 29/00

[52] U.S. Cl. ..... 362/294; 362/373

[58] Field of Search ..... 362/294, 373, 362/310, 345, 264; 165/80.2, 80.3

[56] References Cited

U.S. PATENT DOCUMENTS

| | | | |
|---|---|---|---|
| 4,646,214 | 2/1987 | Mendleski | 362/294 |
| 4,695,930 | 9/1987 | Wierzbicki et al. | 362/294 |
| 4,729,076 | 3/1988 | Masami et al. | 362/373 |
| 4,734,835 | 3/1988 | Vines et al. | 362/373 |
| 4,779,167 | 10/1988 | Nelson | 362/373 |
| 5,034,866 | 7/1991 | Pujol | 362/373 |

*Primary Examiner*—Thomas M. Sember
*Attorney, Agent, or Firm*—Jones, Day, Reavis & Pogue

[57] ABSTRACT

A high-wattage lighting fixture includes a lamp socket assembly for receiving a lamp and a socket wire for supplying electrical power to the lamp socket. A heat sink is provided in thermal contact with the lamp socket assembly. A predetermined length of socket wire is in thermal contact with the heat sink in order to dissipate the heat from the socket and wire. A wiring compartment receives the socket wire and provides a connection to a supply wire. Since the socket wire is cooled down by the heat sink, it can be connected to any grade of supply wire.

7 Claims, 3 Drawing Sheets

LIGHTING FIXTURE

The present invention is directed to the field of lighting fixtures, particularly those which operate at high temperatures and require effective heat dissipation. A number of high-wattage lighting fixtures are known for providing significant illumination, particularly for use as outdoor lighting. Such high-wattage fixtures typically generate a considerable amount of heat, which is conducted through the fixture to the supply wires. The supply wires coming from the source can typically be of any grade and have any temperature rating. Wire having the lowest temperature rating (60° centigrade) can be potentially damaged by a hot fixture, which could result in a short circuit and increased fire hazard.

With previous fixtures, it was necessary to install a supply wire which had a suitable temperature rating for withstanding the heat of the fixture. In the case of retrofitting an existing supply wire, this would entail considerable expense and installation effort. In any event, if low-rated supply wire were used, it would at least have been necessary to install an intermediate junction box to connect the low-rated supply wire to a higher-rated wire (capable of withstanding the temperatures) inside the lighting fixture. The installation and wiring of the junction box also entails additional expense and contributes toward the overall cost of installing high-wattage lighting fixtures.

SUMMARY OF THE INVENTION

In view of the difficulties and drawbacks associated with previous high-wattage lighting fixtures it would be advantageous to provide a light fixture which solves the previous problems.

Therefore, there is a need for a lighting fixture which can be used with supply wire of any temperature rating.

There is also a need for a lighting fixture that does not conduct heat to the supply wire.

There is also a need for a lighting fixture which does not require retrofitting of the supply wire.

There is also a need for a lighting fixture which eliminates the need for an intermediate junction box.

There is also a need for a lighting fixture which reduces the cost of installation.

There is also a need for a lighting fixture which increases safety during operation.

These needs and others are realized by the lighting fixture of the present invention which includes a lamp socket assembly including a lamp socket for receiving an electrical lamp. A socket wire is provided for supplying electrical power to the lamp socket. A heat sink is provided in the thermal contact with the lamp socket assembly. A predetermined length of socket wire is in thermal contact with the heat sink. In this way, heat from the socket and wire is dissipated. A wiring compartment is provided for receiving a supply wire and is connected to the lamp socket assembly. The wiring compartment also receives the socket wire and provides a housing for connection between the socket and supply wires.

As will be appreciated, the invention is capable of other and different embodiments, and its several details are capable of modifications in various respect, all without departing from the invention. Accordingly, the drawings and description are to be regarded as illustrative in nature and not restrictive.

BRIEF DESCRIPTION OF THE DRAWINGS

The embodiments of the invention will now be described by way of example only, with reference to the accompanying figures wherein the members bear like reference numerals and wherein.

DETAILED DESCRIPTION OF THE INVENTION

Figure 1:
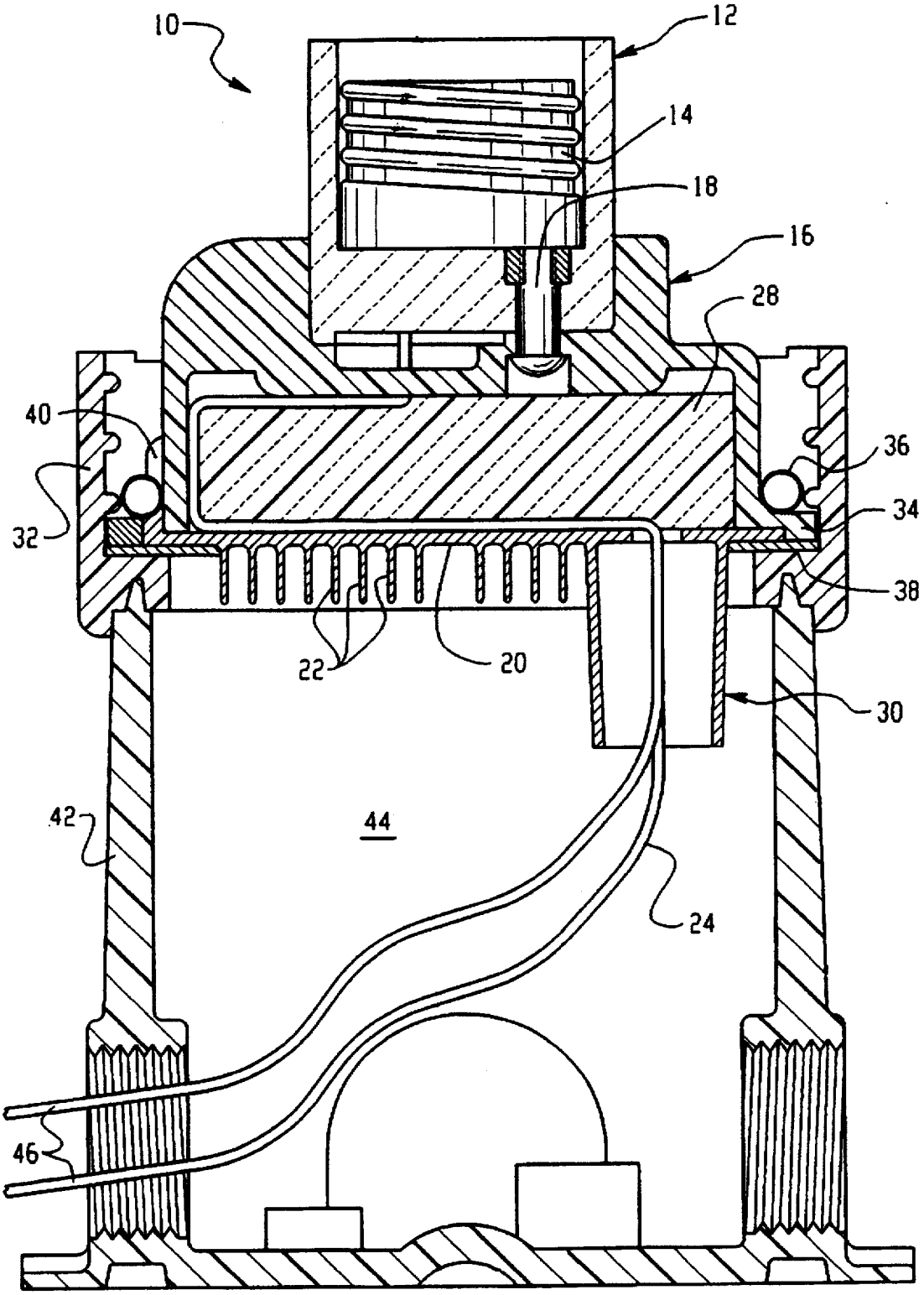
FIG. 1 is a side-sectional view showing the lighting fixture of the present invention.

Referring now to the drawings which are for purposes of illustrating only the preferred embodiment of the present invention and not for purposes of limiting the same, the figures show a high-wattage lighting fixture that provides a safe connection to existing supply wires. The invention is particularly applicable to any lighting application in which a high-wattage fixture must also be weatherproof.

Figure 2:
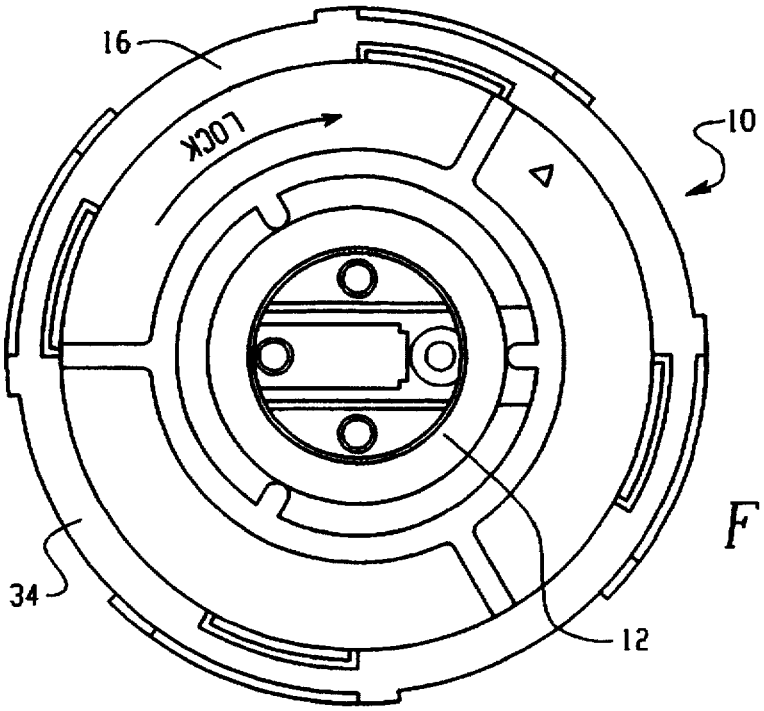
FIG. 2 is a top view of the lamp holder assembly.
Figure 3:
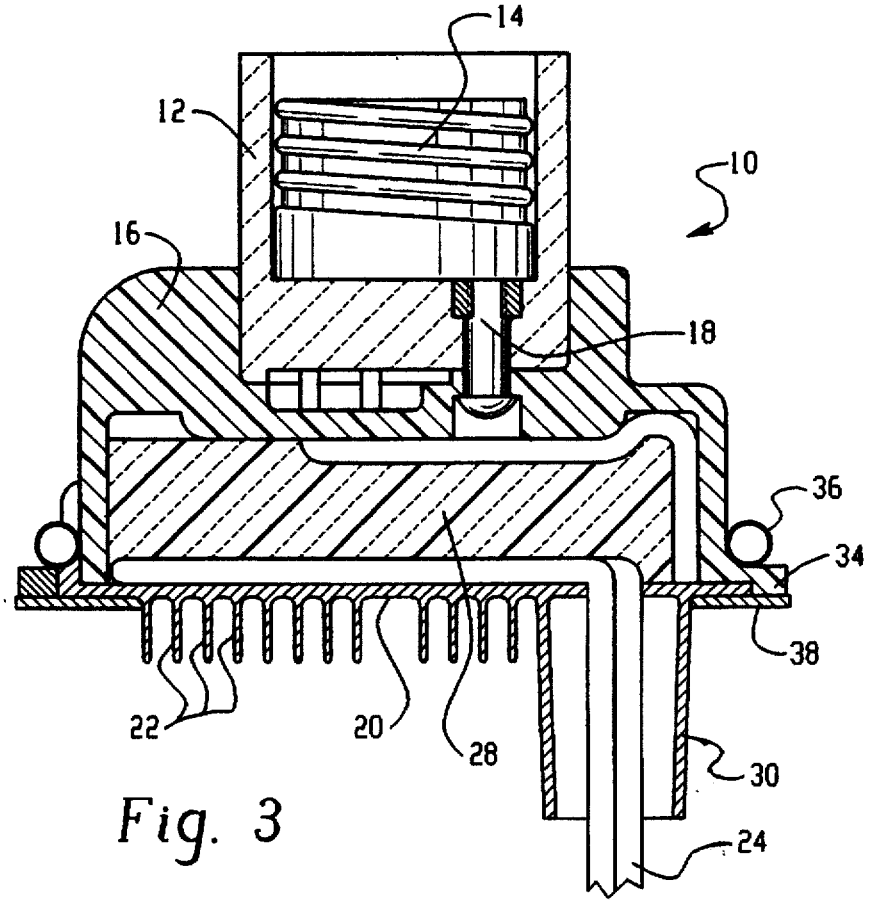
FIG. 3 is a side-elevational view of the lamp holder assembly with heat sink as according to the present invention.

FIG. 1 is a side sectional view of the present lighting fixture, which includes a lamp holder assembly 10 for receiving and retaining a high-wattage electrical lamp, i.e. about 150–200 watts. Details of the lamp holder assembly 10 are shown in the top, side-sectional and exploded views of FIGS. 2–4, respectively. The lamp holder assembly 10 includes a lamp holder 12 including a lamp socket 14 for establishing an electrical connection to the lamp. A lamp holder adaptor 16 is made to receive the lamp holder 12 which is held in stable connection with a screw 18.

Figure 4:
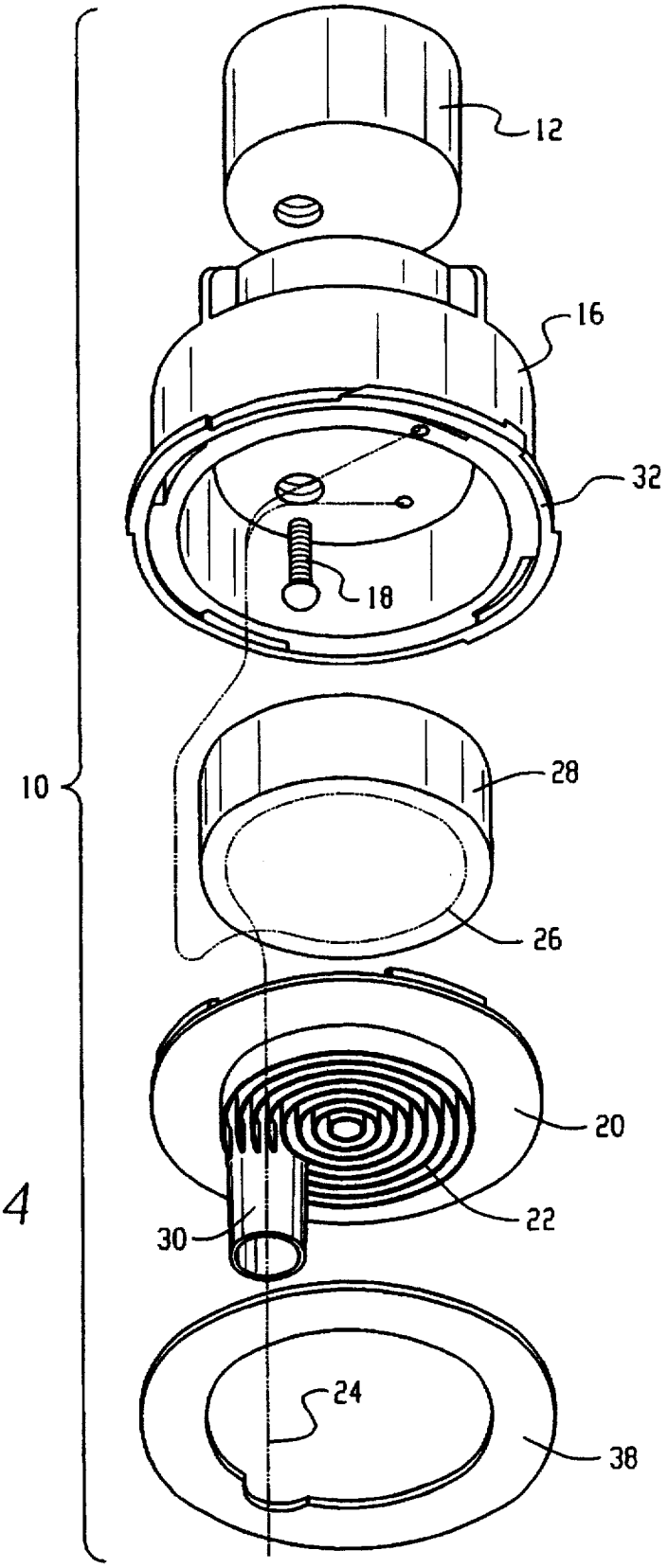
FIG. 4 is an exploded view of the lamp holder assembly with heat sink as according to the present invention.

The lamp holder assembly 10 incorporates a heat sink 20 in thermal contact so as to dissipate the heat generated by the fixture. The heat sink 20 is preferably formed of a plastic material having low thermal conductivity and includes a plurality of fins 22 for dissipating the heat. In FIG. 4, the fins 22 are shown as concentric cylindrical elements, however it is understood that the fins can be any shape without departing from the invention.

In the preferred embodiment, the lamp holder 12 is made of a ceramic material and adaptor 16 is made of a high-temperature non-metallic material or other durable insulator such as are commonly used with electrical fixtures. A socket wire 24 is provided for supplying electrical current to the lamp socket 14. Since the socket wire 24 is a thermal conductor, most of the heat of the fixture is conducted therealong. Thus, a length of socket wire 24 is made as a loop 26 and held in contact against the heat sink 20 so as to increase the contact surface of the wire and thereby increase the thermal conductance between the wire 24 and the sink 20. The heat sink 20 includes a tube 30 for permitting the wire to exit through the heat sink 20. The tube 30 provides an additional air space for dissipating heat from the wire 24.

The socket wire 24 preferably has a high temperature rating, in the range of 150 degrees centigrade. The lamp holder adaptor 16 includes a recess for receiving an insulation layer 28. The insulation layer 28 is preferably made of "Thermafiber™" or another mineral wool. The insulation layer 28 helps maintain the socket wire 24 in secure contact with the heat sink 20 and the adaptor 16, in addition to providing a thermal barrier between the lamp holder 12 and the heat sink 20.

The present lamp holder assembly 10 is configured to be retained and supported by a housing. As shown in FIG. 1, a first housing section 32 is preferably provided having an interrupted threaded inner diameter. Directly below and in-line with the interrupted threads are quarter-turn latch features, for providing a quick and easy connection. The lamp holder assembly 10 includes an interrupted rim 34 which mates with the quarter-turn latch features of the first housing 32. A top gasket 36, preferably a tubular cross-section ring, is provided to seal the rim 34 against a globe (not shown), which is used to enclose the lamp and provide an aesthetic appearance. As an additional securement, a protrusion 40 is provided to secure the gasket 36. A lower gasket 38, is provided for additional seal between the rim 34 and the first housing 32, so as to seal out moisture and provide a thermal barrier between the sink 20 and the wiring compartment, as discussed below.

The first housing section 32 is connected to a second housing section 42 preferably by a technique such as spin welding. The second housing section 42 defines a wiring compartment 44 for the fixture. The tube 30 is opened to the wiring compartment where the cooled socket wire 24 is electrically connected to a supply wire 46. Since the socket wire 24 has been sufficiently cooled by contact with the heat sink 20, the supply wire 46 can be of any grade, thus avoiding expensive retrofitting of the supply wire 46.

The present invention thus provides a high power lamp fixture which can be cooled so as to permit connection to a supply wire having any temperature rating. Also, in addition to dissipating heat, the fins 22 additionally provide a protective barrier between the supply wire 46 and the hot back surface of the sink plate 20. In this way, the present invention offers a universally useful lamp fixture having increased safety and improved economy of installation. In this way, as described hereinabove, the present invention solves many problems associated with previous fixtures and presents improved efficiency. However, it will be appreciated that various changes in the details, materials and arrangement of parts which have been herein described and illustrated in order to explain the nature of the invention may be made by those skilled in the art within the principle and scope of the invention as expressed in the appended claims.

We claim:

1. A high wattage lighting fixture comprising:

a lamp holder assembly including a lamp socket for receiving an electrical lamp;

a socket wire for supplying electrical power to the lamp socket;

a heat sink in thermal contact with said lamp holder assembly so as to dissipate the heat generated by the fixture, wherein an effective predetermined length of said socket wire is in thermal contact with said heat sink; and a wiring compartment for receiving a supply wire, wherein said wiring compartment is in mechanical contact with said lamp holder assembly and receives the socket wire so as to house an electrical connection between the socket wire and the supply wire, wherein the heat sink comprises a finned sink plate for dissipating heat and providing a protective barrier between the lamp holder and the supply wire.

2. The lighting fixture of claim 1 wherein the finned sink plate is connected to and separates both the lamp holder assembly and the wiring compartment.

3. The lighting fixture of claim 1 wherein the finned sink plate includes an apertured tube for admitting the socket wire, wherein the tube provides additional cooling to the socket wire.

4. The lighting fixture of claim 1 wherein the lamp holder assembly further comprises an insulation layer to provide a thermal barrier between the lamp holder assembly and the heat sink.

5. The lighting fixture of claim 4 wherein the insulation layer is in contact with the finned sink plate and wherein a length of socket wire is sandwiched therebetween so as to conduct heat from the wire to the finned sink plate.

6. The lighting fixture of claim 5 wherein at least one loop of socket wire is sandwiched between the insulation layer and the finned sink plate.

7. A high temperature lighting fixture comprising:

a lamp holder assembly including a lamp socket for receiving an electrical lamp;

a socket wire for supplying electrical power to the lamp socket;

an apertured tube in thermal contact with said lamp holder assembly wherein the tube receives an effective predetermined length of said socket wire so as to dissipate the heat conducted along the wire from the fixture;

a heat sink comprising a finned sink plate for dissipating heat and providing a protective barrier between the lamp holder and a supply wire; and a wiring compartment for receiving the supply wire, wherein said wiring compartment is in mechanical contact with said lamp holder assembly and receives the socket wire so as to house an electrical connection between the socket wire and the supply wire.

* * * * *